US008771440B2

(12) United States Patent
Sato et al.

(10) Patent No.: US 8,771,440 B2
(45) **Date of Patent: *Jul. 8, 2014**

(54) NI-BASED SINGLE CRYSTAL SUPERALLOY

(75) Inventors: Akihiro Sato, Tsukuba (JP); Hiroshi Harada, Tsukuba (JP); Kyoko Kawagishi, Tsukuba (JP); Toshiharu Kobayashi, Tsukuba (JP); Tadaharu Yokokawa, Tsukuba (JP); Yutaka Koizumi, Tsukuba (JP); Yasuhiro Aoki, Tokyo (JP); Mikiya Arai, Tokyo (JP); Kazuyoshi Chikugo, Kawasaki (JP); Shoju Masaki, Tokyo (JP)

(73) Assignees: National Institute for Materials Science (JP); IHI Corporation (JP)

( * ) Notice: Subject to any disclaimer, the term of this patent is extended or adjusted under 35 U.S.C. 154(b) by 1317 days.

This patent is subject to a terminal disclaimer.

(21) Appl. No.: 12/441,017

(22) PCT Filed: Sep. 12, 2007

(86) PCT No.: PCT/JP2007/067766

§ 371 (c)(1),
(2), (4) Date: Feb. 5, 2010

(87) PCT Pub. No.: WO2008/032751

PCT Pub. Date: Mar. 20, 2008

(65) Prior Publication Data

US 2010/0143182 A1 Jun. 10, 2010

(30) Foreign Application Priority Data

Sep. 13, 2006 (JP) ..... P2006-248714

(51) Int. Cl.
*C22C 19/05* (2006.01)

(52) U.S. Cl.
USPC ..... 148/428; 420/444; 420/445

(58) Field of Classification Search
USPC ..... 420/443, 444, 445; 148/428
See application file for complete search history.

(56) References Cited

U.S. PATENT DOCUMENTS

| | | | | |
|---|---|---|---|---|
| 4,582,548 | A | 4/1986 | Harris et al. | |
| 4,643,782 | A | 2/1987 | Harris et al. | |
| 4,719,080 | A * | 1/1988 | Duhl et al. | 420/443 |
| 5,366,695 | A | 11/1994 | Erickson | |
| 5,482,789 | A * | 1/1996 | O'Hara et al. | 428/652 |
| 6,966,956 | B2 | 11/2005 | Koizumi et al. | |
| 2003/0075247 | A1 | 4/2003 | Koizumi et al. | |
| 2005/0092398 | A1 | 5/2005 | Kobayashi et al. | |
| 2006/0011271 | A1 | 1/2006 | Kobayashi et al. | |

FOREIGN PATENT DOCUMENTS

| | | | |
|---|---|---|---|
| CA | 1251059 | | 3/1989 |
| CA | 2 387 828 | A1 | 11/2002 |
| CA | 2 479 774 | A1 | 10/2003 |
| CA | 2 508 698 | A1 | 6/2004 |
| EP | 0 208 645 | A2 | 1/1987 |
| FR | 2780983 | | 1/2000 |
| JP | 7-268520 | | 10/1995 |
| JP | 10-195565 | | 7/1998 |
| JP | 2003-49231 | | 2/2003 |
| WO | WO 03/080882 | A1 | 10/2003 |
| WO | WO 2004/053177 | | 6/2004 |

OTHER PUBLICATIONS

Caron, P., "High yγ solvus new generation nickel-based superalloys for single crystal turbine blade applications, "Proceedings of the 9th International Symposium on Superalloys. (p. 737-746).*

Sato et al., "A 5th Generation Ni-Base Single Crystal Superalloy Designed for the Combination of Excellent Oxidation Resistance and Creep Strength at Elevated Temperatures", Journal of the Japan Institute of Metals, Feb. 20, 2006, vol. 70, No. 2, pp. 196-199, with English language Abstract.

Sato et al., "Development of New Coatings for Advanced Ni-Base Superalloys", Journal of the Japan Institute of Metals, Feb. 20, 2006, vol. 70, No. 2, pp. 192-195, with English language Abstract.

International Search Report and Written Opinion from International Searching Authority dated Dec. 11, 2007 (Japanese language) from PCT/JP2007/067766, 11 pages.

International Search Report mailed Dec. 11, 2007 (English language) from PCT JP/2007/067766, 2 pages.

Office Action for Russian Application No. 2009113022(017724) mailed on Jun. 3, 2010.

Office Action dated Jun. 26, 2012 in corresponding Canadian Patent Application No. 2,663,632.

* cited by examiner

*Primary Examiner* — Jessee Roe
(74) *Attorney, Agent, or Firm* — Ostrolenk Faber LLP

(57) ABSTRACT

A Ni-based single crystal superalloy according to the invention has, for example, a composition including: 5.0 to 7.0 wt % of Al, 4.0 to 10.0 wt % of Ta, 1.1 to 4.5 wt % of Mo, 4.0 to 10.0 wt % of W, 3.1 to 8.0 wt % of Re, 0.0 to 2.0 wt % of Hf, 2.5 to 8.5 wt % of Cr, 0.0 to 9.9 wt % of Co, 0.0 to 4.0 wt % of Nb, and 1.0 to 14.0 wt % of Ru in terms of weight ratio; and the remainder including Ni and incidental impurities. In addition, the contents of Cr, Hf and Al are preferably set so as to satisfy the equation OP≥108. According to the Ni-based single crystal superalloy of the invention, high creep strength can be maintained and the oxidation resistance can be improved.

11 Claims, 10 Drawing Sheets

NI-BASED SINGLE CRYSTAL SUPERALLOY

CROSS-REFERENCE TO RELATED APPLICATIONS

The present application is a 35 U.S.C. §§371 national phase conversion of PCT/JP2007/067766, filed Sep. 12, 2007, which claims priority of Japanese Patent Application No. 2006-248714, filed Sep. 13, 2006. The PCT International Application was published in the Japanese language.

TECHNICAL FIELD

The present invention relates to a Ni-based single crystal superalloy which has improved creep strength, and particularly, to the improvement of a Ni-based single crystal superalloy to improve oxidation resistance.

The present application claims priority from Japanese Patent Application No. 2006-248714, filed on Sep. 13, 2006, in Japan, the contents of which are incorporated herein by reference.

BACKGROUND ART

A Ni-based single crystal superalloy is used as a material for components or products which are used for long periods of time under high temperature, such as for a blade or a vane used in jet engines for airplanes or gas turbines. The Ni-based single crystal superalloy is a superalloy obtained by adding Ni (nickel) as a base to Al (aluminum) so as to give a $Ni_3Al$ type precipitate for strengthening, then mixing with metal having high melting point such as Cr (chrome), W (tungsten) and Ta (tantalum) to give an alloy, and making it into a single crystal. As the Ni-based single crystal superalloy, a first generation superalloy not including Re (rhenium), a second generation superalloy including about 3 wt % of Re, and a third generation superalloy including 5 to 6 wt % of Re have already developed, and creep strength has been improved with the advance of generation. For example, CMSX-2 (produced by Canon-Muskegon Corporation, see Patent Document 1) has been known as a first generation Ni-based single crystal superalloy, CMSX-4 (produced by Canon-Muskegon Corporation, see Patent Document 2) has been known as a second generation Ni-based single crystal superalloy, and CMSX-10 (produced by Canon-Muskegon Corporation, see Patent Document 3) has been known as a third generation Ni-based single crystal superalloy.

The Ni-based single crystal superalloy is subjected to a solution treatment at a predetermined temperature and then subjected to an aging treatment to obtain a metal constitution with improved strength. This superalloy is referred to as a so-called precipitation hardening-type alloy, which has a constitution including a matrix (γ phase) as an austenite phase and a precipitated phase (γ' phase) dispersed and precipitated in the matrix as an intermediate regular phase.

The CMSX-10 which is a third generation Ni-based single crystal superalloy is produced for the purpose of achieving improved creep strength under high temperature compared with a second generation Ni-based single crystal superalloy. However, since the content of Re is high, specifically, 5 wt % or more, and exceeds the amount of a solid solution of Re in the matrix (γ phase), the remaining Re combines with other elements and a so-called TCP (Topologically Close Packed) phase is precipitated under high temperature. As a result, the amount of the TCP phase increases due to the long-time use under high temperature and thus a problem occurs in that the creep strength lowers.

In order to solve the problem of the third generation Ni-based single crystal superalloy, Ru (ruthenium) suppressing the TCP phase has been added and contents of other constituent elements have been set to their optimum ranges to adjust a lattice constant of the matrix (γ phase) and a lattice constant of the precipitated phase (γ' phase) to their optimum values and thus a Ni-based single crystal superalloy with improved strength under high temperature has been developed. Such a Ni-based single crystal superalloy includes a fourth generation superalloy including up to about 3 wt % of Ru and a fifth generation superalloy including 4 wt % or more of Ru, and the creep strength improves in accordance with the advancement of generations. For example, TMS-138 (produced by NIMS-IHI, see Patent Document 4) has been known as a fourth generation Ni-based single crystal superalloy and TMS-162 (produced by NIMS-IHI, see Patent Document 5) has been known as a fifth generation Ni-based single crystal superalloy.

The TMS-138 as a fourth generation Ni-based single crystal superalloy and the TMS-162 as a fifth generation Ni-based single crystal superalloy are superalloys which have improved creep strength, as described above. However, when test pieces are heated at 1100° C. for 500 hours, it is found that the weight change is greater in the negative direction.

When an elemental map of a cross-section of a blade made of TMS-138 after a jet engine test was analyzed, oxides of Ni and Co (cobalt) were distributed in the form of a layer, and under the oxides, an oxide of Al or Cr was distributed in the form of grains on the outermost surface of the blade. When the oxide of Al is formed in the form of a layer, the growth is slow and stable, and it becomes solid, and thus it acts as an oxidation resistant protective film. However, the oxides of Ni and Co grow fast and their adhesion with a base material is lower than the oxide of Al and thus peeling occurs. Accordingly, the peeling phenomenon occurs as the oxidation proceeds, and the weight change in the negative direction increases. That is, a large weight change indicates that the oxidation resistance is not excellent.

[Patent Document 1] U.S. Pat. No. 4,582,548

[Patent Document 2] U.S. Pat. No. 4,643,782

[Patent Document 3] U.S. Pat. No. 5,366,695

[Patent Document 4] U.S. Pat. No. 6,966,956

[Patent Document 5] US Patent Application, Publication No. 2006/0011271

DISCLOSURE OF THE INVENTION

Problem that the Invention is to Solve

The invention is contrived in view of the above-described problem and an object of the invention is to provide a Ni-based single crystal superalloy in which the oxidation resistance can be improved while maintaining the high creep strength which is the characteristic of the fourth and fifth generation Ni-based single crystal superalloys.

Means for Solving the Problem

The inventors of the present application have conducted intensive study based on the above-described fourth and fifth generation Ni-based single crystal superalloys and as a result, found that (1) creep strength can be maintained and oxidation resistance can be improved by setting Al, Cr and Hf (hafnium) to their optimum ranges; and (2) the creep strength also can be maintained and the oxidation resistance also can be improved by increasing the content of Cr excellent in oxidation resistance and employing upgraded content with the consideration of constitution stability and the suppression of a TCP phase.

The invention is provided on the basis of the findings.

That is, a Ni-based single crystal superalloy according to the invention has a composition including: 5.0 to 7.0 wt % of Al, 4.0 to 10.0 wt % of Ta, 1.1 to 4.5 wt % of Mo, 4.0 to 10.0 wt % of W, 3.1 to 8.0 wt % of Re, 0.0 to 2.0 wt % of Hf, 2.5 to 8.5 wt % of Cr, 0.0 to 9.9 wt % of Co, 0.0 to 4.0 wt % of Nb, and 1.0 to 14.0 wt % of Ru in terms of weight ratio; and the remainder including Ni and incidental impurities. Herein, the contents of Hf and Cr may be in a range of 0.0 to 0.5 wt % of Hf and in a range of 5.1 to 8.5 wt % of Cr, respectively. Further, the contents of Hf, Cr, Mo and Ta may be in a range of 0.0 to 0.5 wt % of Hf, in a range of 5.1 to 8.5 wt % of Cr, in a range of 2.1 to 4.5 wt % of Mo, and in a range of 4.0 to 6.0 wt % of Ta, respectively.

In addition, a Ni-based single crystal superalloy according to the invention has a composition including: 5.0 to 6.5 wt % of Al, 4.0 to 6.5 wt % of Ta, 2.1 to 4.0 wt % of Mo, 4.0 to 6.0 wt % of W, 4.5 to 7.5 wt % of Re, 0.1 to 2.0 wt % of Hf, 2.5 to 8.5 wt % of Cr, 4.5 to 9.5 wt % of Co, 0.0 to 1.5 wt % of Nb, and 1.5 to 6.5 wt % of Ru in terms of weight ratio; and the remainder including Ni and incidental impurities. Herein, the content of Cr may be in a range of 4.1 to 8.5 wt %. In addition, the content of Cr may be in a range of 5.1 to 8.5 wt %.

Further, the contents of Hf and Cr may be in a range of 0.1 to 0.5 wt % of Hf and in a range of 4.1 to 8.5 wt % of Cr, respectively. Moreover, the contents of Hf and Cr may be in a range of 0.1 to 0.5 wt % of Hf and in a range of 5.1 to 8.5 wt % of Cr, respectively.

Further, a Ni-based single crystal superalloy according to the invention has a composition including: 5.5 to 5.9 wt % of Al, 4.7 to 5.6 wt % of Ta, 2.2 to 2.8 wt % of Mo, 4.4 to 5.6 wt % of W, 5.0 to 6.8 wt % of Re, 0.1 to 2.0 wt % of Hf, 4.0 to 6.7 wt % of Cr, 5.3 to 9.0 wt % of Co, 0.0 to 1.0 wt % of Nb, and 2.3 to 5.9 wt % of Ru in terms of weight ratio; and the remainder including Ni and incidental impurities. Herein, the contents of Hf and Cr may be in a range of 0.1 to 0.5 wt % of Hf and in a range of 5.1 to 6.7 wt % of Cr, respectively.

In addition, when an OP (Oxidation Parameter) of the above-described Ni-based single crystal superalloy=5.5×[Cr (wt %)]+15.0×[Al (wt %)]+9.5×[Hf (wt %)] is set, it is preferable that the expression OP≥108 be satisfied. In addition, OP≥113 may be satisfied.

Moreover, the above-described Ni-based single crystal superalloy may further include 1.0 wt % or less of Ti (titanium) in terms of weight ratio. In addition, the Ni-based single crystal superalloy may further include at least one component of B (boron), C (carbon), Si (silicon), Y (yttrium), La (lanthanum), Ce (cerium), V (vanadium) and Zr (zirconium). Further, it is preferable that the amount of B is not more than 0.05 wt %, the amount of C is not more than 0.15 wt %, the amount of Si is not more than 0.1 wt %, the amount of Y is not more than 0.1 wt %, the amount of La is not more than 0.1 wt %, the amount of Ce is not more than 0.1 wt %, the amount of V is not more than 1 wt % and the amount of Zr is not more than 0.1 wt %. When the lattice constant of a matrix is denoted by a1 and lattice constant of a precipitated phase is denoted by a2, it is preferable that the equation a2≤0.999a1 be satisfied. In addition, it is more preferable that the equation a2≤0.9965a1 be satisfied. When a formula, that is, $P=-200[Cr (wt \%)]+80[Mo (wt \%)]-20[Mo (wt \%)]^2+200[W (wt \%)]-14[W (wt \%)]^2+30[Ta (wt \%)]-1.5[Ta (wt \%)]^2+2.5[Co (wt \%)]+1200[Al (wt \%)]-100[Al (wt \%)]^2+100[Re (wt \%)]+1000[Hf (wt \%)]-2000[Hf (wt \%)]^2+700[Hf (wt \%)]^3$ is set, the expression P<4500 may be satisfied.

Advantage of the Invention

According to a Ni-based single crystal superalloy of the invention, by setting Al, Cr and Hf to their optimum ranges, oxidation resistance can be improved while creep strength is maintained. In addition, it is possible to set Al, Cr and Hf to their optimum ranges easily by employing a parameter OP=5.5×[Cr (wt %)]+15.0×[Al (wt %)]+9.5×[Hf (wt %)].

BEST MODE FOR CARRYING OUT THE INVENTION

Figure 1:
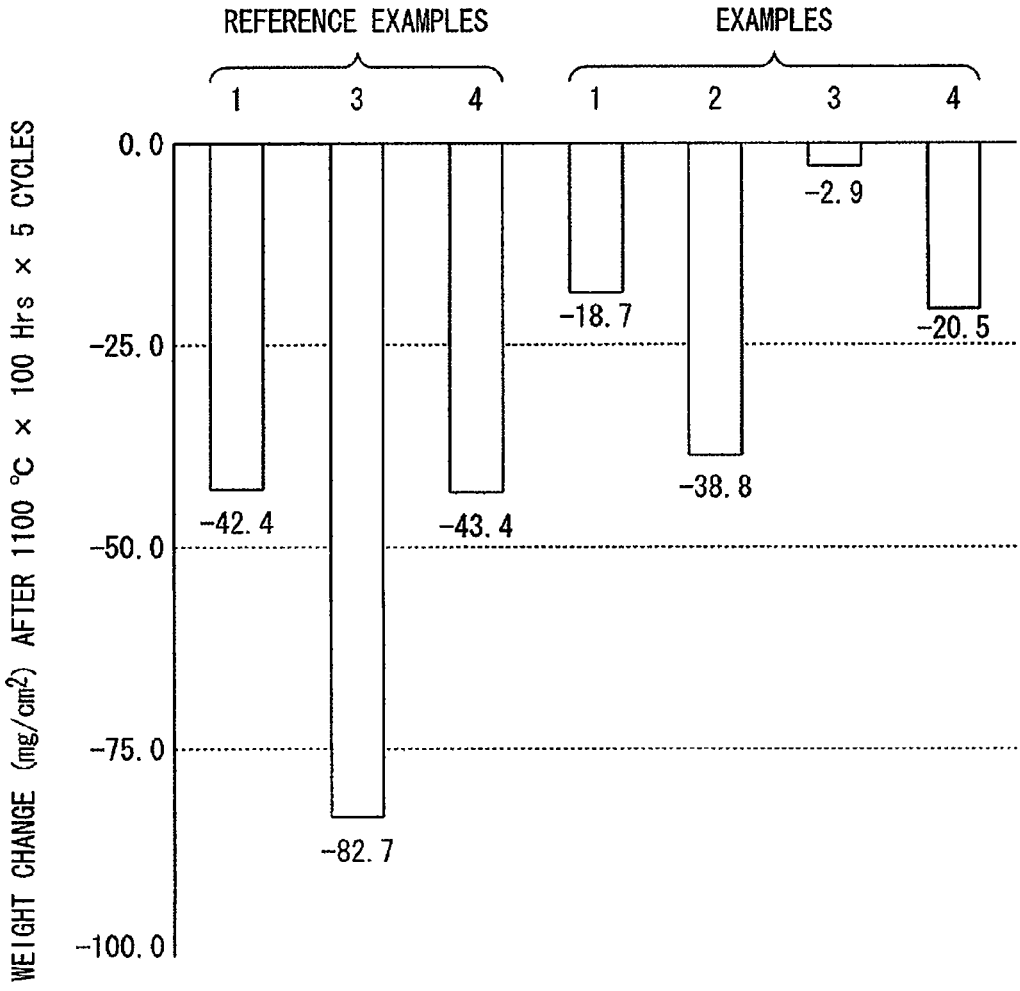
FIG. 1 is a diagram illustrating weight changes (mg/cm$^2$) of alloys which had been processed at 1100° C.×100 Hrs×5 cycles.

Hereinafter, embodiments of the invention will be described in detail. A Ni-based single crystal superalloy according to the invention is an alloy including components such as Al, Ta, Mo, W, Re, Hf, Cr, Co and Ru, and Ni (remainder) with incidental impurities.

The Ni-based single crystal superalloy is, for example, an alloy having a composition including 5.0 to 7.0 wt % of Al, 4.0 to 10.0 wt % of Ta, 1.1 to 4.5 wt % of Mo, 4.0 to 10.0 wt % of W, 3.1 to 8.0 wt % of Re, 0.0 to 2.0 wt % of Hf, 2.5 to 8.5 wt % of Cr, 0.0 to 9.9 wt % of Co, 0.0 to 4.0 wt % of Nb, and 1.0 to 14.0 wt % of Ru in terms of weight ratio, and the remainder including Ni and the incidental impurities.

In addition, the Ni-based single crystal superalloy is, for example, an alloy having a composition including 5.0 to 6.5 wt % of Al, 4.0 to 6.5 wt % of Ta, 2.1 to 4.0 wt % of Mo, 4.0 to 6.0 wt % of W, 4.5 to 7.5 wt % of Re, 0.1 to 2.0 wt % of Hf, 2.5 to 8.5 wt % of Cr, 4.5 to 9.5 wt % of Co, 0.0 to 1.5 wt % of Nb, and 1.5 to 6.5 wt % of Ru in terms of weight ratio, and the remainder including Ni and the incidental impurities.

Moreover, the Ni-based single crystal superalloy is, for example, an alloy having a composition including 5.5 to 5.9 wt % of Al, 4.7 to 5.6 wt % of Ta, 2.2 to 2.8 wt % of Mo, 4.4 to 5.6 wt % of W, 5.0 to 6.8 wt % of Re, 0.1 to 2.0 wt % of Hf, 4.0 to 6.7 wt % of Cr, 5.3 to 9.0 wt % of Co, 0.0 to 1.0 wt % of Nb, and 2.3 to 5.9 wt % of Ru in terms of weight ratio, and the remainder including Ni and the incidental impurities.

All of the superalloys have a γ phase (matrix) as an austenite phase and a γ' phase (precipitated phase) as an intermediate regular phase dispersed and precipitated in the matrix. The γ' phase mainly includes an intermetallic compound represented by $Ni_3Al$. The high-temperature strength of the Ni-based single crystal superalloy is improved by the γ' phase.

The invention is characterized in that Al, Cr and Hf are set to their optimum ranges. First, these components will be described, and subsequently, other components will be described.

Cr is an element excellent in oxidation resistance and improves, together with Hf and Al, the hot corrosion resistance of the Ni-based single crystal superalloy.

A content (weight ratio) of Cr is preferably in the range of 2.5 to 8.5 wt %, more preferably in the range of 4.1 to 8.5 wt %, even more preferably in the range of 4.0 to 6.7 wt %, and most preferably in the range of 5.1 to 8.5 wt %, when weight ratio of Hf is not more than 2.0 wt %, preferably in the range of 0.1 to 2.0 wt %.

In addition, the content of Cr is preferably in the range of 4.1 to 8.5 wt %, more preferably in the range of 5.1 to 8.5 wt %, and most preferably in the range of 5.1 to 6.7 wt %, when the weight ratio of Hf is not more than 0.5 wt % and preferably in the range of 0.1 to 0.5 wt %.

The content of Cr less than 2.5 wt % is not preferable because the hot corrosion resistance cannot be ensured at a desired level. The content of Cr more than 8.5 wt % is not preferable because the precipitation of the γ' phase is suppressed and a harmful phase such as a σ phase or a μ phase is generated, thereby reducing the high-temperature strength.

Al combines with Ni to form the intermetallic compound represented by $Ni_3Al$ constituting the γ' phase finely and uniformly dispersed and precipitated in the matrix at the ratio of 60 to 70% in volume percent, so as to improve the high-temperature strength. Further, Al is an element excellent in oxidation resistance and improves, together with Cr and Hf, the hot corrosion resistance of the Ni-based single crystal superalloy.

A content (weight ratio) of Al is preferably in the range of 5.0 to 7.0 wt %, more preferably in the range of 5.0 to 6.5 wt %, and most preferably in the range of 5.5 to 5.9 wt %.

The content of Al less than 5.0 wt % is not preferable because a precipitation amount of the γ' phase becomes insufficient and the high-temperature strength and the hot corrosion resistance cannot be thus ensured at a desired level. The content of Al more than 7.0 wt % is not preferable because a large amount of coarse γ phases, so-called eutectic γ' phase, is formed, and a solution treatment cannot be performed and high strength at high temperature cannot be thus ensured.

Hf is a grain boundary segregation element and strengthens a grain boundary by being segregated at the boundary between the γ phase and the γ' phase, thereby improving the high-temperature strength. In addition, Hf is an element excellent in oxidation resistance and improves, together with Cr and Al, the hot corrosion resistance of the Ni-based single crystal superalloy.

A content (weight ratio) of Hf is preferably not more than 2.0 wt %, more preferably not more than 0.5 wt %, even more preferably in the range of 0.1 to 2.0 wt %, and most preferably in the range of 0.1 to 0.5 wt %.

The content of Hf less than 0.01 wt % is not preferable because a precipitation amount of the γ' phase becomes insufficient and the high-temperature strength cannot be thus ensured at a desired level. However, there may be a case where the content of Hf is set to 0 to less than 0.01 wt % when necessary. The content of Hf more than 2.0 wt % is not preferable because local melting is induced and the high-temperature strength may be thus reduced.

The above-described Cr, Hf and Al can be set to their optimum ranges by a parameter $OP=5.5\times[Cr\ (wt\ \%)]+15.0\times[Al\ (wt\ \%)]+9.5\times[Hf\ (wt\ \%)]$ satisfying the equation $OP\geq108$, and more preferably $OP\geq113$.

Mo is solid-soluted into the γ phase as the matrix under the coexistence with W and Ta to increase the high-temperature strength, and contributes to the high-temperature strength by precipitation and hardening. Further, Mo largely contributes to a dislocation spacing in the dislocation network and a lattice misfit to be described later.

A content of Mo is preferably in the range of 1.1 to 4.5 wt %, more preferably in the range of 2.1 to 4.5 wt %, even more preferably in the range of 2.1 to 4.0 wt %, and most preferably in the range of 2.2 to 2.8 wt %.

The content of Mo less than 1.1 wt % is not preferable because the high-temperature strength cannot be ensured at a desired level. The content of Mo more than 4.5 wt % is not preferable because the high-temperature strength is reduced and the hot corrosion resistance is also reduced.

W improves the high-temperature strength by the action of the solid solution strengthening and the precipitation hardening under the coexistence with Mo and Ta as described in the above.

A content of W is preferably in the range of 4.0 to 10.0 wt %, more preferably in the range of 4.0 to 6.0 wt %, and most preferably in the range of 4.4 to 5.6 wt %.

The content of W less than 4.0 wt % is not preferable because the high-temperature strength cannot be ensured at a desired level. The content of W more than 10.0 wt % is not preferable because the hot corrosion resistance is reduced.

Ta improves the high-temperature strength by the action of the solid solution strengthening and the precipitation hardening under the coexistence with Mo and W as described above, and a part of which allows precipitation and hardening for the γ' phase thereby improving the high-temperature strength.

A content of Ta is preferably in the range of 4.0 to 10.0 wt %, more preferably in the range of 4.0 to 6.5 wt %, even more preferably in the range of 4.0 to 6.0 wt %, and most preferably in the range of 4.7 to 5.6 wt %.

The content of Ta less than 4.0 wt % is not preferable because the high-temperature strength cannot be ensured at a desired level. The content of Ta more than 10.0 wt % is not preferable because a σ phase or a μ phase is generated and high-temperature strength is thus reduced.

Co increases solid solution limits of Al, Ta and the like for the matrix at high temperature and allows dispersion and precipitation of the fine γ' phase by a heat treatment to improve the high-temperature strength.

A content of Co is preferably in the range of 0.0 to 9.9 wt %, more preferably in the range of 4.5 to 9.5 wt %, and most preferably in the range of 5.3 to 9.0 wt %.

The content of Co less than 0.1 wt % is not preferable because a precipitation amount of the γ' phase becomes insufficient and the high-temperature strength cannot be thus ensured at a desired level. However, there may be a case where the amount of Co is set to 0 to less than 0.1 wt % when necessary. The content of Co is more than 9.9 wt % is not preferable because the balance with other elements such as Al, Ta, Mo, W, Hf and Cr is disrupted, and a harmful phase is precipitated and the high-temperature strength is thus reduced.

Re is solid-soluted into the γ phase as the matrix and improves the high-temperature strength by the solid solution strengthening. Moreover, it has an advantage of improvement of the corrosion resistance. When a large amount of Re is added, there is a possibility that a TCP phase as a harmful phase is precipitated at high temperature and the high-temperature strength is reduced.

A content of Re is preferably in the range of 3.1 to 8.0 wt %, more preferably in the range of 4.5 to 7.5 wt %, and most preferably in the range of 5.0 to 6.8 wt %.

The content of Re less than 3.1 wt % is not preferable because the solid-solution strengthening of the γ phase is insufficient and the high-temperature strength cannot be thus ensured at a desired level. The content of Re more than 8.0 wt % is not preferable because a TCP phase is precipitated at high temperature and the high-temperature strength cannot be thus ensured at a high level.

Ru suppresses the precipitation of a TCP phase to improve the high-temperature strength.

A content of Ru is preferably in the range of 1.0 to 14.0 wt %, more preferably in the range of 1.5 to 6.5 wt %, and most preferably in the range of 2.3 to 5.9 wt %.

The content of Ru less than 1.0 wt % is not preferable because a TCP phase is precipitated at high temperature and the high-temperature strength cannot be thus ensured at a high level. The content of Ru more than 14.0 wt % is not preferable because a ϵ phase is precipitated and the high-temperature strength is thus reduced.

The invention is characterized in that Al, Cr and Hf are set to their optimum ranges. In addition, by adjusting the contents of Ta, Mo, W, Co, Re and Ni, the lattice misfit (to be described later) which is calculated by the lattice constant of the γ phase and the lattice constant of the γ' phase, and the dislocation spacing in the dislocation network can be set to their optimum ranges to improve the high-temperature strength, and by adding Ru, the precipitation of a TCP phase can be suppressed. Particularly, by setting the contents of Al, Cr, Ta and Mo as described above, manufacturing cost of the alloy can be suppressed. In addition, fatigue strength can be improved and the lattice misfit and the dislocation spacing in the dislocation network can be set to optimum values. Further, in the case where the content of Cr is set to a high value to improve the oxidation resistance, a part of the amount of Ta may be substituted with Nb when phase stability is damaged. The content of Mo may be set to a low value when the lattice misfit becomes larger negatively and the content of Ru can be set to a high value in order to suppress more of a TCP phase.

In usage environments at a high temperature from 1273 K (1000° C.) to 1373 K (1100° C.), when the lattice constant of the γ phase as the matrix is denoted by a1 and the lattice constant of the γ' phase as the precipitated phase is denoted by a2, the relationship between a1 and a2 is preferably set to satisfy the equation $a2 \leq 0.999a1$. That is, the lattice constant a2 of the precipitated phase is preferably −0.1% or less of the lattice constant a1 of the matrix. In addition, the lattice constant a2 of the precipitated phase may be 0.9965 or less of the lattice constant a1 of the matrix. In this case, the relationship between the above-described a1 and a2 satisfies the equation $a2 \leq 0.9965a1$. A percentage of the lattice constant a2 of the precipitated phase with respect to the lattice constant a1 of the matrix is called "lattice misfit".

When the lattice constants a1 and a2 have such a relationship, the precipitated phase is coarsened in a direction vertical to a load direction while being precipitated in the matrix by a heat treatment. Thus, the movement of dislocation defects in the alloy constitution under the presence of stress is minimal and the creep strength increases.

According to the above-described Ni-based single crystal superalloy, the precipitation of a TCP phase causing the reduction of the creep strength at high temperature is suppressed by adding Ru. In addition, the lattice constant of the matrix (γ phase) and the lattice constant of the precipitated phase (γ' phase) can be set to their optimum values by setting the contents of other constituent elements to their optimum ranges. Accordingly, the creep strength under high temperature can be improved.

Further, the above-described Ni-based single crystal superalloy may further contain Ti. In this case, a content of Ti is preferably not more than 1.0 wt %. The content of Ti more than 1.0 wt % is not preferable because a harmful phase is precipitated and the high-temperature strength is thus reduced.

Moreover, the above-described Ni-based single crystal superalloy may further contain Nb. In this case, a content of Nb is preferably not more than 4.0 wt %, more preferably not more than 1.5 wt %, and most preferably not more than 1.0 wt %. The content of Nb more than 4.0 wt % is not preferable because a harmful phase is precipitated and the high-temperature strength is thus reduced. The high-temperature strength also be improved by setting a total of the contents of Ta, Nb and Ti (Ta+Nb+Ti) to 4.0 to 10.0 wt %.

In addition, the above-described Ni-based single crystal superalloy may contain, for example, B, C, Si, Y, La, Ce, V, Zr and the like, other than incidental impurities. When the Ni-based single crystal superalloy contains at least one component of B, C, Si, Y, La, Ce, V and Zr, the contents of the components are preferably set such that the amount of B is not more than 0.05 wt %, the amount of C is not more than 0.15 wt %, the amount of Si is not more than 0.1 wt %, the amount of Y is not more than 0.1 wt %, the amount of La is not more than 0.1 wt %, the amount of Ce is not more than 0.1 wt %, the amount of V is not more than 1 wt % and the amount of Zr is not more than 0.1 wt %. Contents of these components more than the above ranges are not preferable because a harmful phase is precipitated and the high-temperature strength is thus reduced.

In addition, regarding the above-described Ni-based single crystal superalloy, a parameter P determined by $P=-200[Cr\ (wt\ \%)]+80[Mo\ (wt\ \%)]-20[Mo\ (wt\ \%)]^2+200[W\ (wt\ \%)]-14[W\ (wt\ \%)]^2+30[Ta\ (wt\ \%)]-1.5[Ta\ (wt\ \%)]^2+2.5[Co\ (wt\ \%)]+1200[Al\ (wt\ \%)]-100[Al\ (wt\ \%)]^2+100[Re\ (wt\ \%)]+1000[Hf\ (wt\ \%)]-2000[Hf\ (wt\ \%)]^2+700[Hf\ (wt\ \%)]^3$ is preferably set to be less than 4500. The P value functions as a parameter for predicting total advantages of the compositions in the above formula, particularly, high-temperature creep life. The P value is described in detail in Japanese Patent Application, Publication No. 10-195565.

There exist conventional Ni-based single crystal superalloys causing reverse distribution, but the Ni-based single crystal superalloy according to the invention does not cause reverse distribution.

EXAMPLE 1

Next, examples will be shown to describe advantages of the invention. Melts of various Ni-based single crystal superalloys were adjusted using a vacuum melting furnace and a plurality of alloy ingots different to each other in composition was cast using the alloy melts. Composition of the alloy ingots (reference examples 1 to 4 and examples 1 to 15) are shown in Table 1.

TABLE 1

| Specimen (Alloy Name) | Elements (wt %) | | | | | | | | | | | OP value |
|---|---|---|---|---|---|---|---|---|---|---|---|---|
| | Al | Ta | Mo | W | Re | Hf | Cr | Co | Nb | Ru | Ni | |
| Reference Example 1 | 5.9 | 5.9 | 2.9 | 5.9 | 4.9 | 0.1 | 2.9 | 5.9 | | 2.0 | Remainder | 105.4 |
| Reference Example 2 | 5.7 | 5.6 | 2.8 | 5.6 | 5.8 | 0.1 | 3.2 | 5.8 | | 3.6 | Remainder | 104.1 |
| Reference Example 3 | 5.6 | 5.0 | 2.6 | 5.6 | 6.9 | 0.1 | 3.2 | 5.6 | 0.5 | 5.0 | Remainder | 102.6 |
| Reference Example 4 | 5.8 | 5.8 | 3.9 | 5.8 | 4.9 | 0.1 | 2.9 | 5.8 | | 6.0 | Remainder | 103.9 |
| Example 1 | 5.8 | 5.1 | 2.4 | 5.2 | 5.1 | 0.1 | 6.2 | 5.8 | 0.5 | 3.3 | Remainder | 121.5 |
| Example 2 | 5.9 | 5.1 | 2.4 | 5.6 | 5.2 | 0.1 | 5.1 | 5.8 | 0.5 | 2.5 | Remainder | 117.5 |
| Example 3 | 5.8 | 5.2 | 2.6 | 5.5 | 5.8 | 0.1 | 4.2 | 5.8 | 0.5 | 3.7 | Remainder | 110.8 |
| Example 4 | 5.6 | 4.9 | 2.3 | 5.1 | 6.8 | 0.1 | 5.2 | 5.8 | 0.5 | 5.9 | Remainder | 113.6 |
| Example 5 | 5.6 | 5.6 | 2.4 | 5.0 | 6.4 | 0.1 | 4.8 | 5.6 | | 5.0 | Remainder | 111.4 |
| Example 6 | 5.6 | 5.0 | 2.4 | 5.0 | 6.4 | 0.1 | 4.6 | 5.6 | 0.6 | 5.0 | Remainder | 110.3 |
| Example 7 | 5.6 | 5.6 | 2.3 | 4.4 | 6.4 | 0.1 | 6.7 | 5.6 | | 5.0 | Remainder | 121.8 |
| Example 8 | 5.8 | 5.6 | 2.4 | 5.4 | 5.0 | 0.1 | 5.1 | 5.8 | | 2.7 | Remainder | 116.0 |
| Example 9 | 5.8 | 5.6 | 2.2 | 5.1 | 5.0 | 0.1 | 5.9 | 5.8 | | 3.1 | Remainder | 120.4 |
| Example 10 | 5.8 | 5.6 | 2.1 | 4.8 | 5.0 | 0.1 | 6.6 | 5.8 | | 3.5 | Remainder | 124.3 |
| Example 11 | 6.1 | 5.5 | 2.1 | 5.2 | 2.1 | 0.7 | 2.9 | 5.7 | | 0.9 | Remainder | 114.1 |
| Example 12 | 6.3 | 5.5 | 2.2 | 5.3 | 1.4 | 1.6 | 2.9 | 5.7 | | 1.4 | Remainder | 125.9 |
| Example 13 | 5.9 | 5.9 | 2.9 | 5.9 | 2.9 | 2.1 | 3.1 | 5.9 | | 2.0 | Remainder | 125.5 |
| Example 14 | 5.8 | 5.6 | 2.4 | 5.2 | 5.6 | 0.1 | 5.1 | 5.8 | | 3.6 | Remainder | 116.0 |
| Example 15 | 5.7 | 5.6 | 2.2 | 4.6 | 5.6 | 0.1 | 6.7 | 5.8 | | 3.6 | Remainder | 123.3 |

Next, the alloy ingots were subjected to a solution treatment and an aging treatment and states of the alloy microstructures were observed by a scanning electron microscope (SEM). Regarding the solution treatment for the examples 1 to 15, the initial solution treatment temperature was set in the range of 1503 K (1230° C.) to 1573 K (1300° C.) and raised in stages through multistage steps to set the final solution treatment temperature in the range of 1583 K (1310° C.) to 1613 K (1340° C.), and the alloy ingots were kept for several hours to obtain target microstructures and then cooled. The processing time required for the solution treatment was in the range of 6 to 40 hours. In addition, regarding the aging treatment for the examples 1 to 4, only a primary aging treatment which includes keeping for 4 hours at a temperature of 1273 K (1000° C.) to 1423 K (1150° C.) was performed, and regarding the aging treatment for the examples 5 to 15, the primary aging treatment which includes keeping for 4 hours at a temperature of 1273 K (1000° C.) to 1423 K (1150° C.) and a secondary aging treatment which includes keeping for 16 to 20 hours at a temperature of 1143 K (870° C.) were sequentially performed. As a result, no TCP phase was confirmed in the constitutions of the specimens.

Next, the specimens subjected to the solution treatment and the aging treatment were subjected to a test for measuring a weight change. In the examples 1 to 4, a test sample of the alloy according to each example was placed in an atmospheric heat treatment furnace in which the temperature was maintained at 1373 K (1100° C.) and was taken out at a time interval of 100 hours to measure the weight thereof after the lapse of 500 hours (5 cycles). The result is shown in FIG. 1. For comparison, the same measurement was performed for the reference examples 1, 3 and 4.

As illustrated in the drawing, the weight changes were more than "−40 mg/cm$^2$" in the reference examples. All of the examples of the invention gave lower values than in the reference examples. The example 2 gave relatively near value to the reference examples. However, the examples 1 and 4 gave about half the values of the reference examples 1 and 4 and the example 3 gave a value not more than one tenth thereof.

Figure 2:
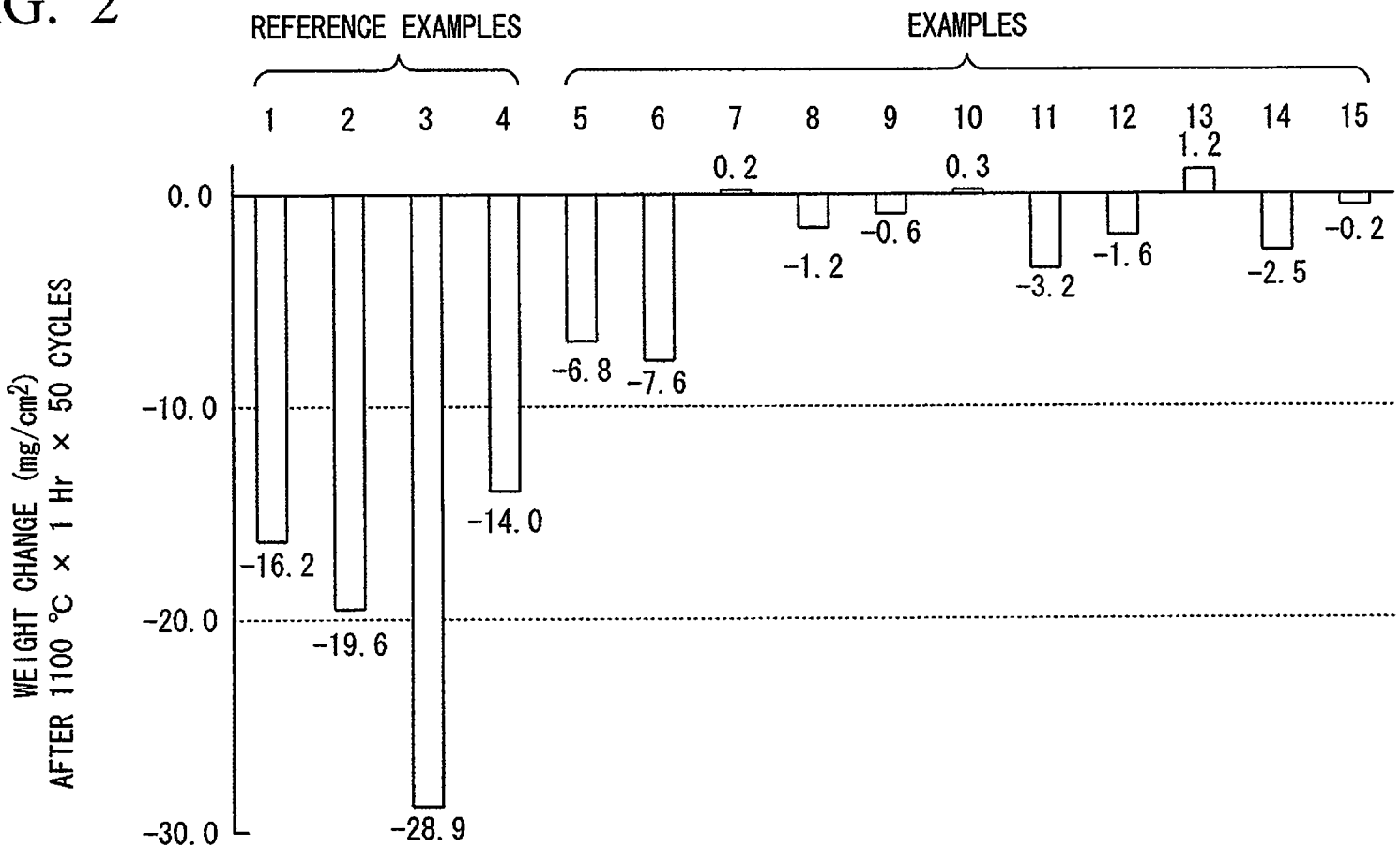
FIG. 2 is a diagram illustrating weight changes (mg/cm$^2$) of the alloys which had been processed at 1100° C.×1 Hr×50 cycles.

In the examples 5 to 15, a sample piece of each example was placed in an atmospheric heat treatment furnace in which the temperature was maintained at 1373 K (1100° C.) and taken out every 1 hour to measure the weight thereof after the lapse of 50 hours (50 cycles). The result is shown in FIG. 2. For comparison, the same measurement was performed for the reference examples 1 to 4.

As illustrated in the drawing, the weight changes were more than "−14 mg/cm$^2$" in the reference examples. All of the examples of the invention gave lower values than in the reference examples. When the reference example 4 which gave the smallest weight change among those of the reference examples was compared with the examples, the result obtained was that the examples 5 and 6 which are those giving large weight changes among those of the examples give about half the value of the reference example 4.

Figure 3:
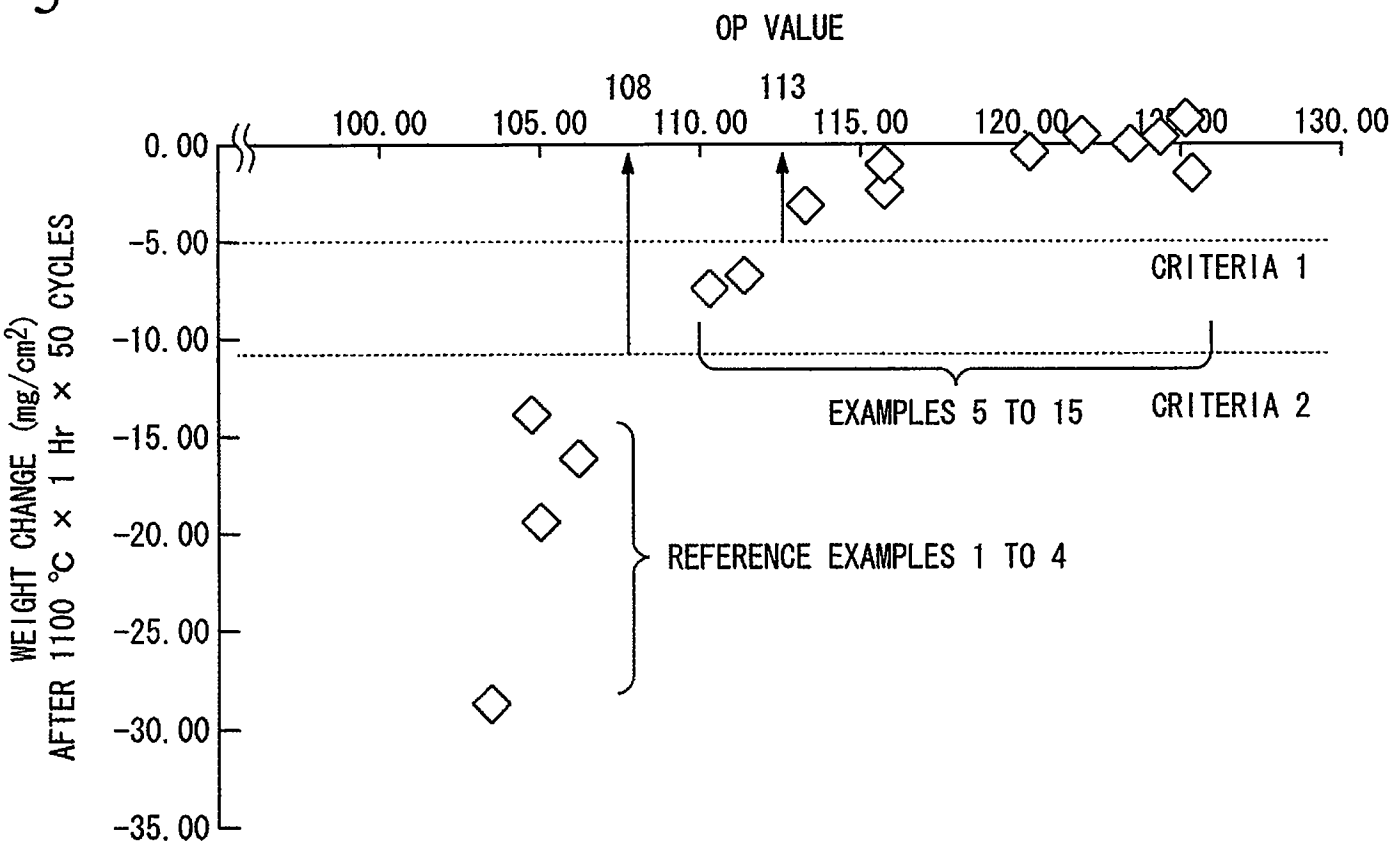
FIG. 3 is a diagram illustrating the relationship between an OP value and the measurement result of the weight change illustrated in FIG. 2.

Further, FIG. 3 is a diagram illustrating the relationship between the OP value and the measurement result of the weight change illustrated in FIG. 2. Herein, a vertical axis represents the weight change (mg/cm$^2$) and a horizontal axis represents the OP value shown in Table 1. A correlative relationship is shown in the drawing between the weight change and the OP value in the reference examples 1 to 4 and the examples 5 to 15. Specifically, grouping into Criteria 1 and Criteria 2 can be made and it is found that a Ni-based single crystal superalloy which shows smaller weight change than those in the reference examples 1 to 4, that is, is excellent in oxidation resistance, can be obtained when the OP value (108) exceeds a reference of Criteria 2. Further, it is found that, when high oxidation resistance is required, the composition can be set to the range not less than the OP value (113) exceeding a reference of Criteria 1.

Figure 4:
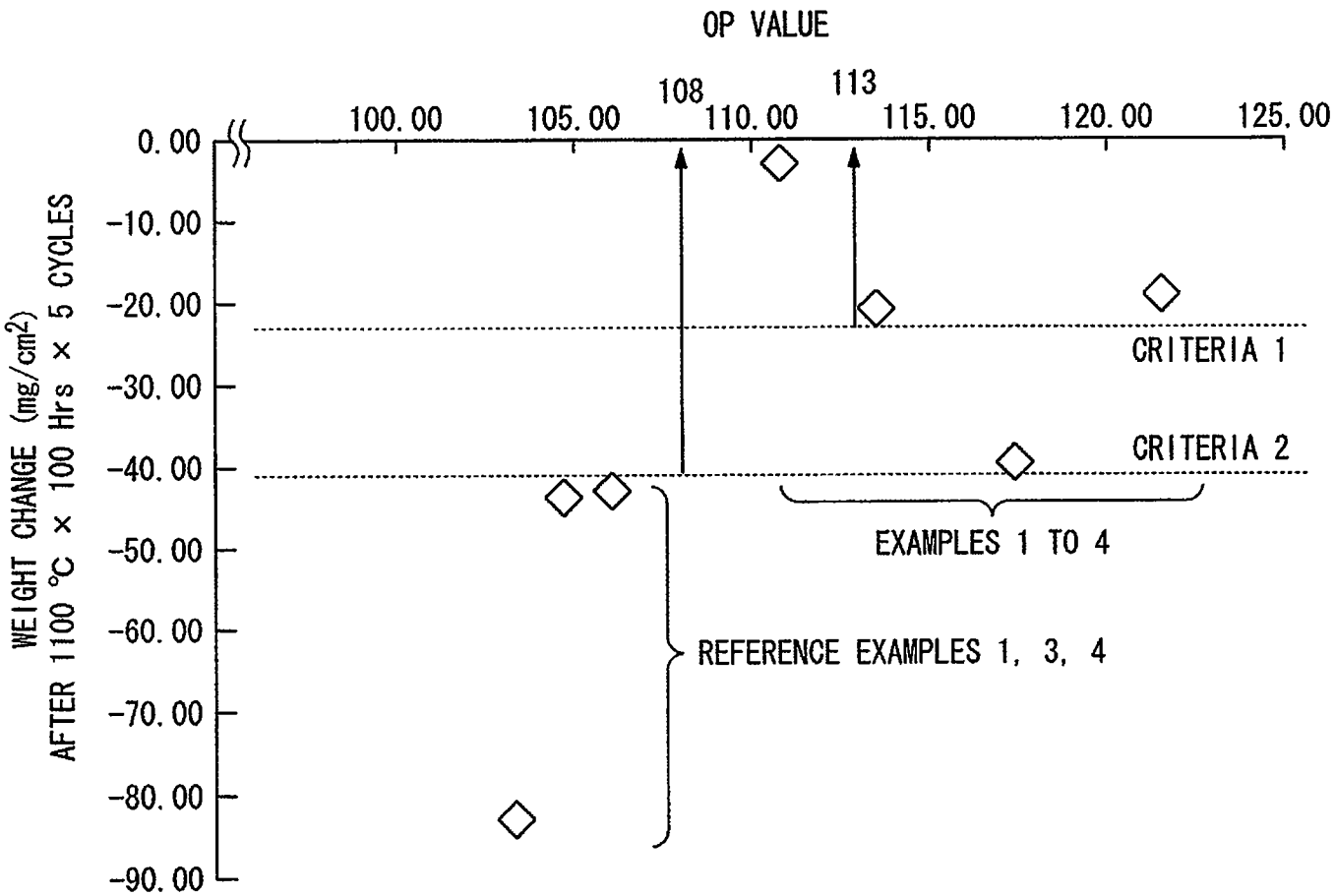
FIG. 4 is a diagram illustrating the relationship between an OP value and the measurement result of the weight change illustrated in FIG. 1.

In addition,

FIG. 4 is a diagram illustrating the relationship between the OP value and the measurement result of the weight change illustrated in FIG. 1. A vertical axis represents the weight change (mg/cm$^2$) and a horizontal axis represents the OP value shown in Table 1. From FIG. 4, it is found that the examples 1 to 4 have almost the same result as in FIG. 3.

Figure 5:
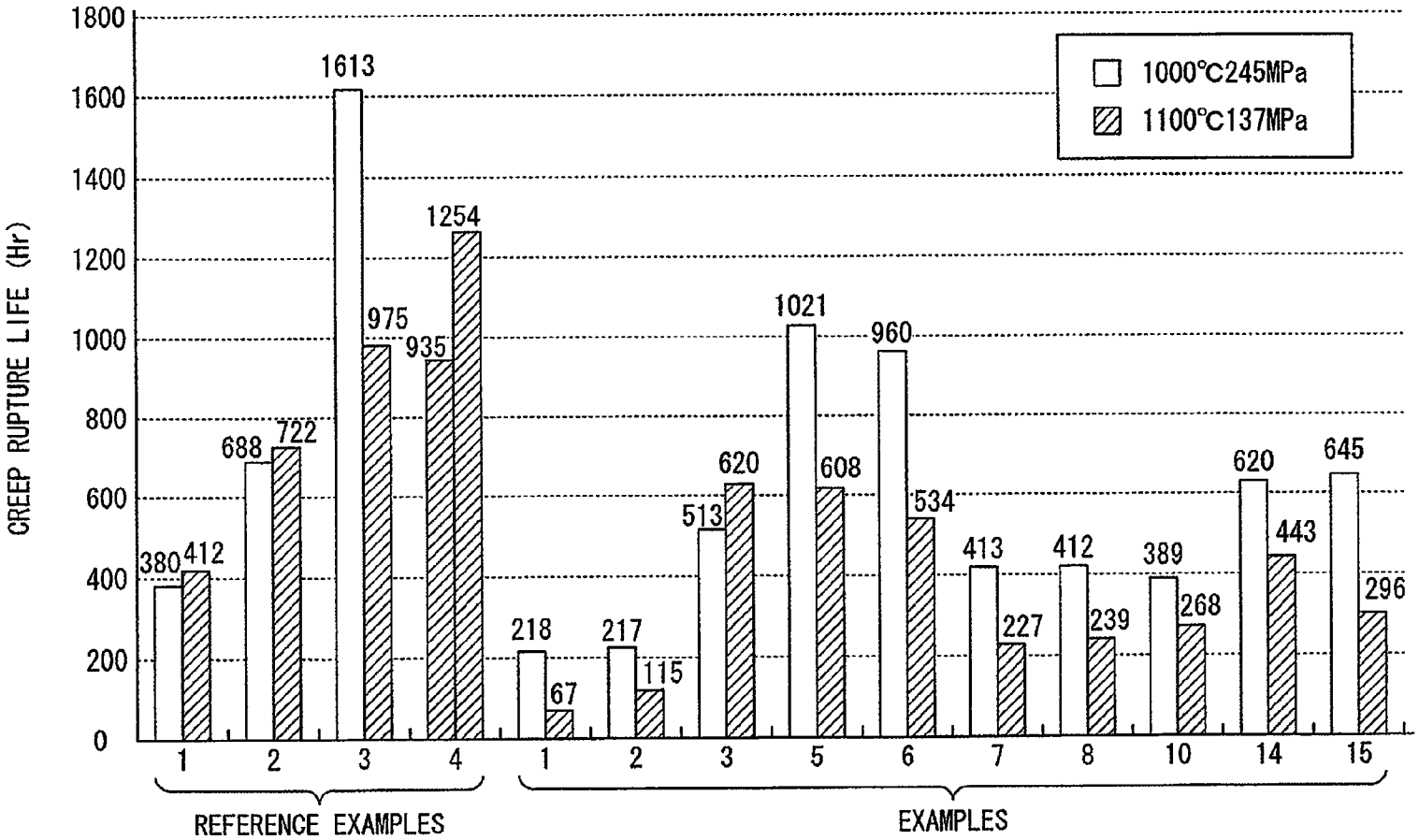
FIG. 5 is a diagram illustrating the measurement result of creep rupture life (Hr) of the alloys.

Next, creep rupture life (Hr) was measured in the examples 1 to 3, 5 to 8, 10, 14 and 15. The result is illustrated in FIG. 5.

For comparison, the same measurement was performed for the reference examples 1 to 4.

The creep rupture life was obtained by measuring the time (lifetime) until which each specimen is creep-ruptured under each of the conditions of temperature of 1000° C. and stress of 245 MPa and temperature of 1100° C. and stress of 137 MPa.

As illustrated in the drawing, the example 1 and the example 2 give lower values than in the reference example 1 in which the creep rupture life (Hr) is-short, but the other examples give the same-or higher values as/than in the reference example 1.

For examples 16 to 22, a plurality of alloy ingots different to each other in composition was cast by the same method as in the examples 1 to 15. The compositions of the alloy ingots are shown in Table 2.

TABLE 2

| Specimen (Alloy Name) | Elements (wt %) | | | | | | | | | | | OP value |
|---|---|---|---|---|---|---|---|---|---|---|---|---|
| | Al | Ta | Mo | W | Re | Hf | Co | Cr | Nb | Ru | Ni | |
| Example 16 | 5.6 | 4.8 | 2.3 | 4.8 | 6.5 | 0.1 | 5.7 | 5.1 | 0.5 | 5.3 | Remainder | 113.0 |
| Example 17 | 5.6 | 4.8 | 2.3 | 5.0 | 6.8 | 0.1 | 5.7 | 5.1 | 1.0 | 5.5 | Remainder | 113.0 |
| Example 18 | 5.5 | 4.8 | 2.2 | 5.0 | 6.7 | 0.1 | 5.8 | 5.2 | 0.5 | 6.0 | Remainder | 112.1 |
| Example 19 | 5.7 | 5.1 | 2.6 | 5.6 | 5.9 | 0.1 | 5.8 | 4.2 | 0.5 | 3.4 | Remainder | 108.7 |
| Example 20 | 5.8 | 5.0 | 2.6 | 5.5 | 5.8 | 0.1 | 5.8 | 4.2 | 0.5 | 3.4 | Remainder | 111.1 |
| Example 21 | 5.8 | 5.2 | 2.6 | 5.4 | 5.5 | 0.1 | 5.8 | 4.2 | 0.5 | 3.4 | Remainder | 110.9 |
| Example 22 | 5.8 | 5.2 | 2.6 | 5.4 | 5.8 | 0.1 | 5.8 | 4.3 | 0.5 | 3.4 | Remainder | 112.0 |

Figure 6:
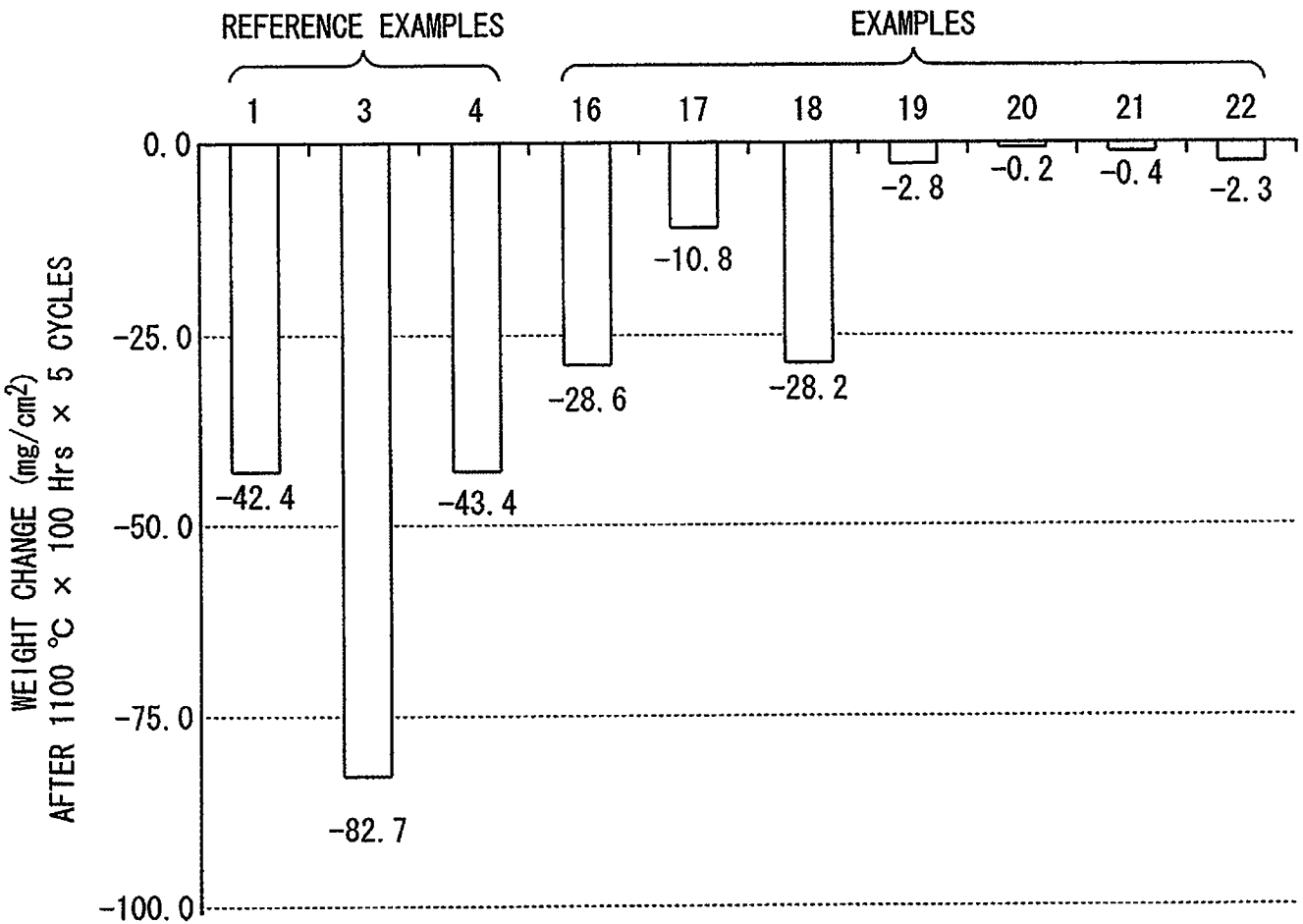
FIG. 6 is a diagram illustrating weight changes (mg/cm$^2$) of the alloys which had been processed at 1100° C.×100 Hrs×5 cycles.

Next, the specimens subjected to the solution treatment and the aging treatment were subjected to a test for measuring a weight change. That is, in the examples 16 to 22, a test sample of the alloy according to each example was placed in an atmospheric heat treatment furnace in which the temperature was maintained at 1373 K (1100° C.) and taken out at a time interval of 100 hours to measure the weight thereof after the lapse of 500 hours (5 cycles). The result is shown in FIG. 6. For comparison, the same measurement was performed for the reference examples 1, 3 and 4.

As illustrated in the drawing, the weight changes more than "−40 mg/cm$^2$" were shown in the reference examples. However, all of the examples of the invention gave lower values than in the reference examples.

Figure 7:
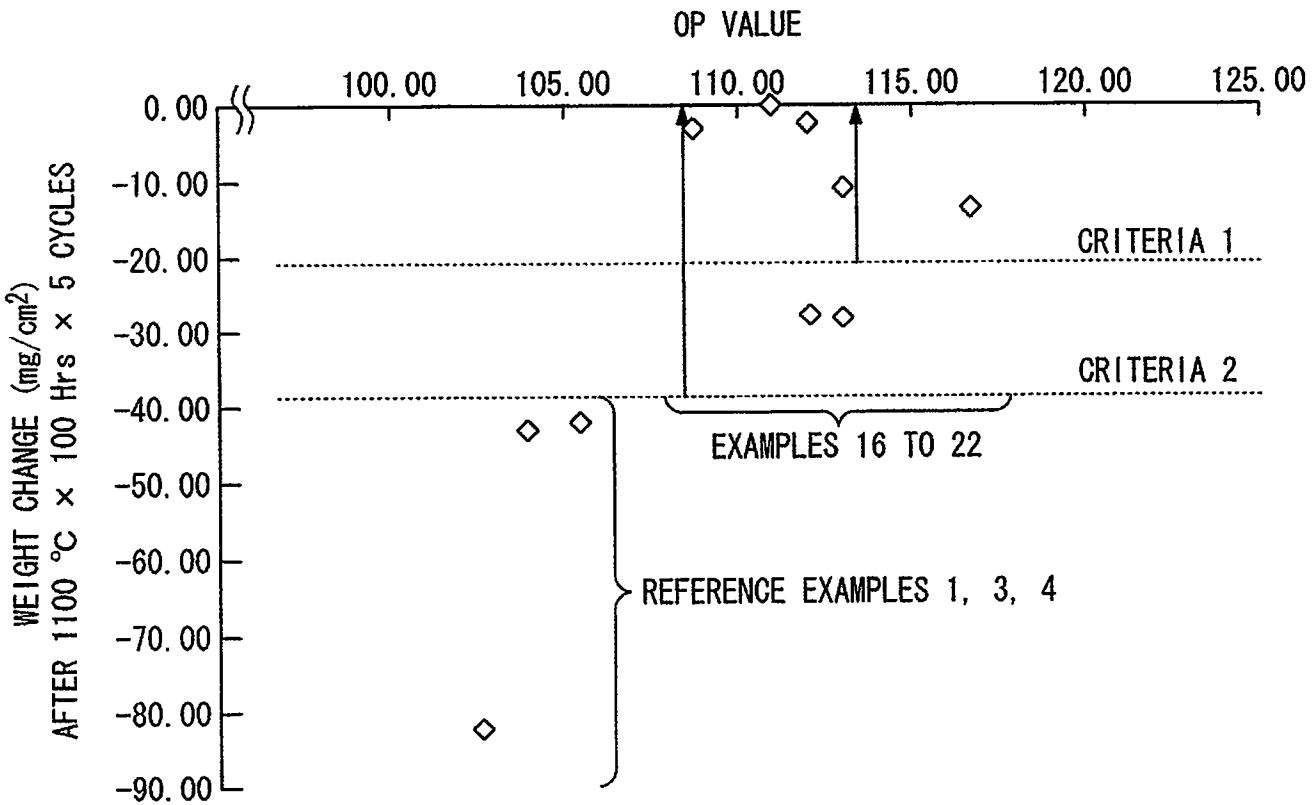
FIG. 7 is a diagram illustrating the relationship between an OP value and the measurement result of the weight change illustrated in FIG. 6.

Further, FIG. 7 is a diagram illustrating the relationship between the OP value and the measurement result of the weight change illustrated in FIG. 6. Herein, a vertical axis represents the weight change (mg/cm$^2$) and a horizontal axis represents the OP value shown in Table 2. From FIG. 7, it is found that the examples 16 to 22 show almost the same results as in FIGS. 3 and 4.

Figure 8:
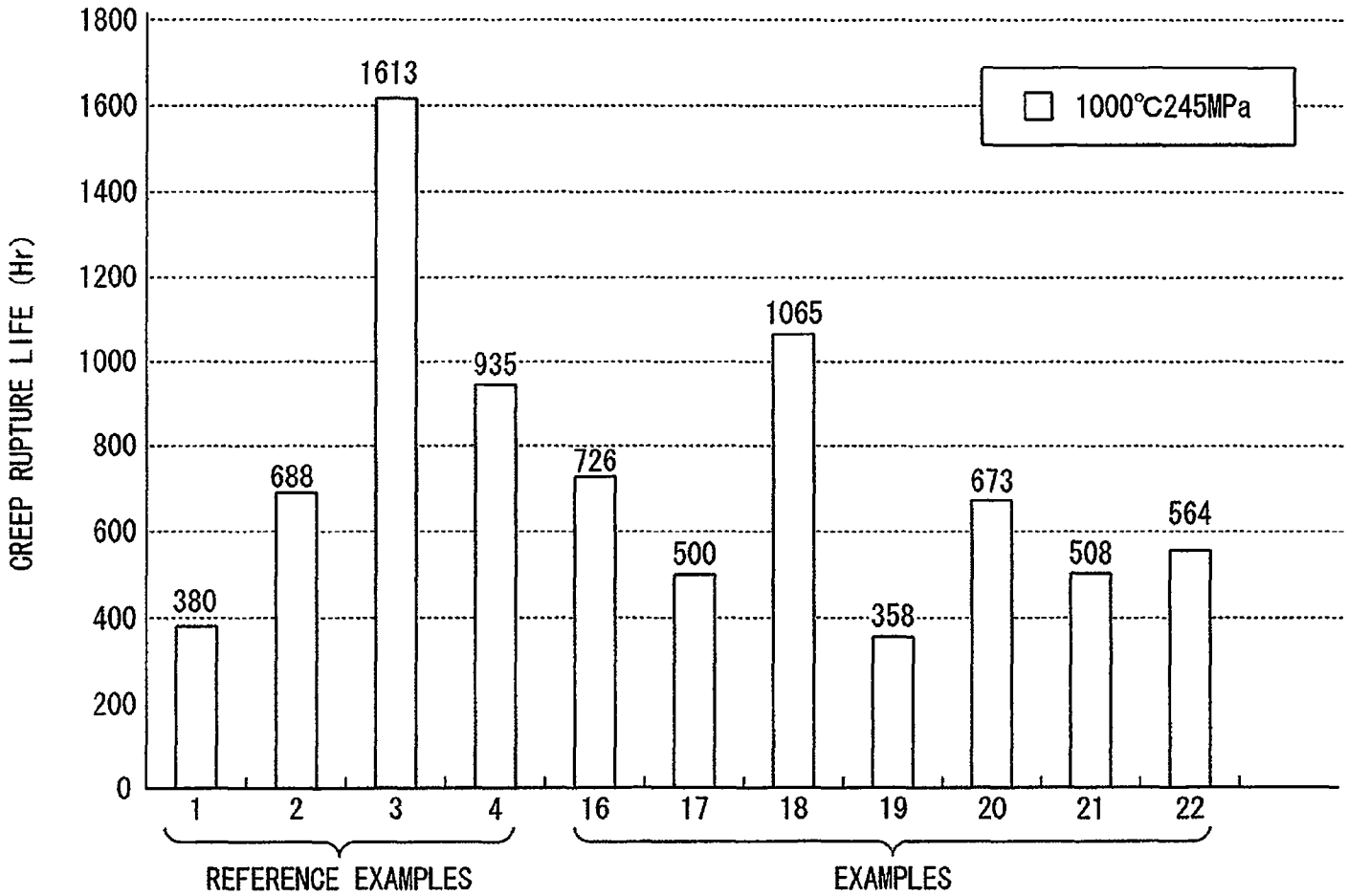
FIG. 8 is a diagram illustrating the measurement result of creep rupture life (Hr) of the alloys.

Next, creep rupture life (Hr) was measured in the examples 16 to 22. The result is illustrated in FIG. 8. For comparison, the same measurement was performed for the reference examples 1 to 4.

As illustrated in the drawing, the example 19 gives a lower value than in the reference example 1 in which the creep rupture life (Hr) is short, but the other examples give higher values than in the reference example 1.

Figure 9:
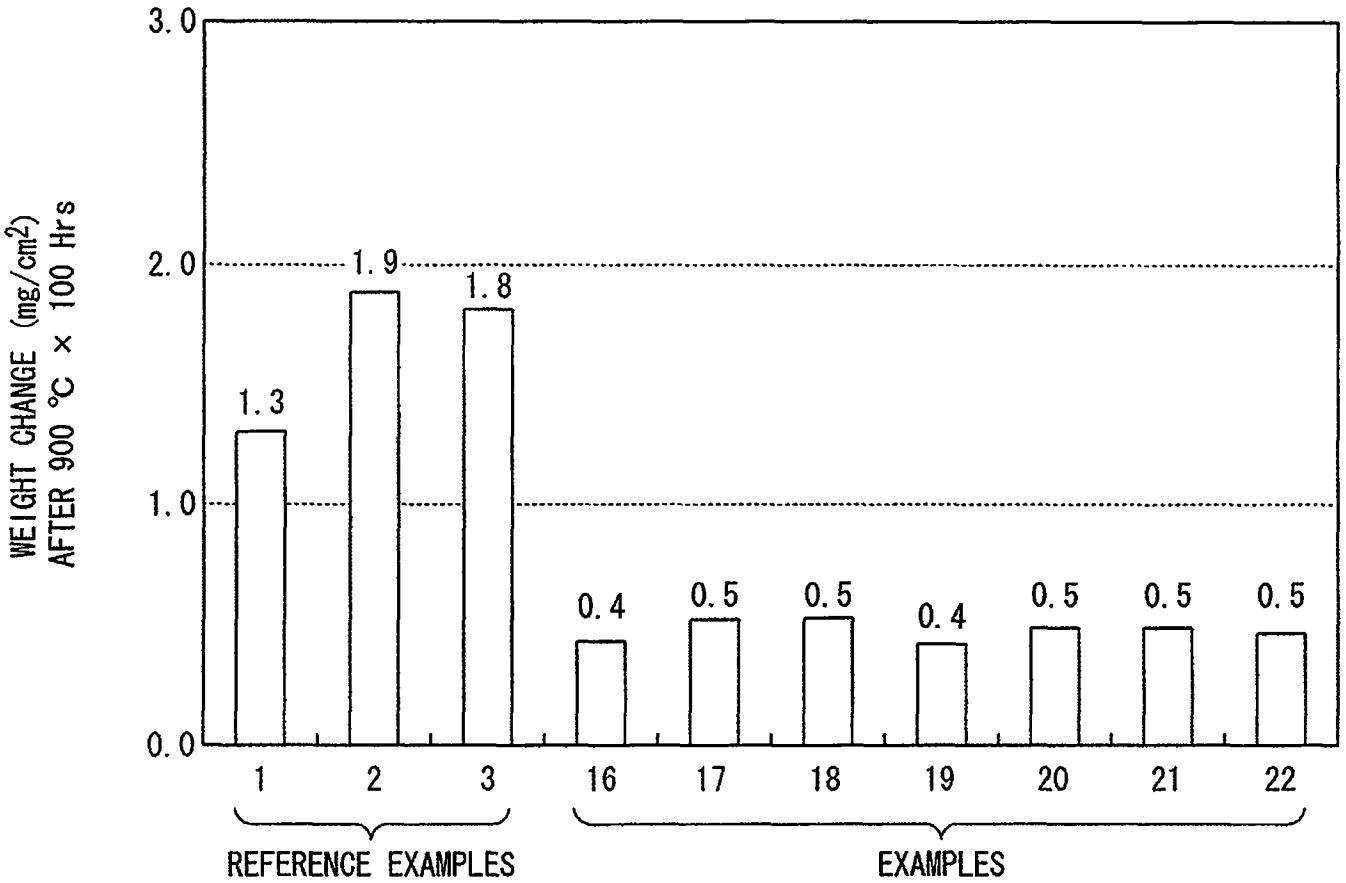
FIG. 9 is a diagram illustrating weight changes (mg/cm$^2$) of the alloys which had been processed at 900° C.×100 Hrs.

In the examples 16 to 22, a sample piece of the alloy according to each example was placed in an atmospheric heat treatment furnace in which temperature was maintained at 1173 K (900° C.) to measure the weight thereof after the lapse of 100 hours. The result is shown in FIG. 9. For comparison, the same measurement was performed for the reference examples 1 to 3.

As illustrated in the drawing, the weight changes more than "1.3 mg/cm$^2$" were shown in the reference examples. However, all of the examples of the invention gave lower values than in the reference examples.

Figure 10:
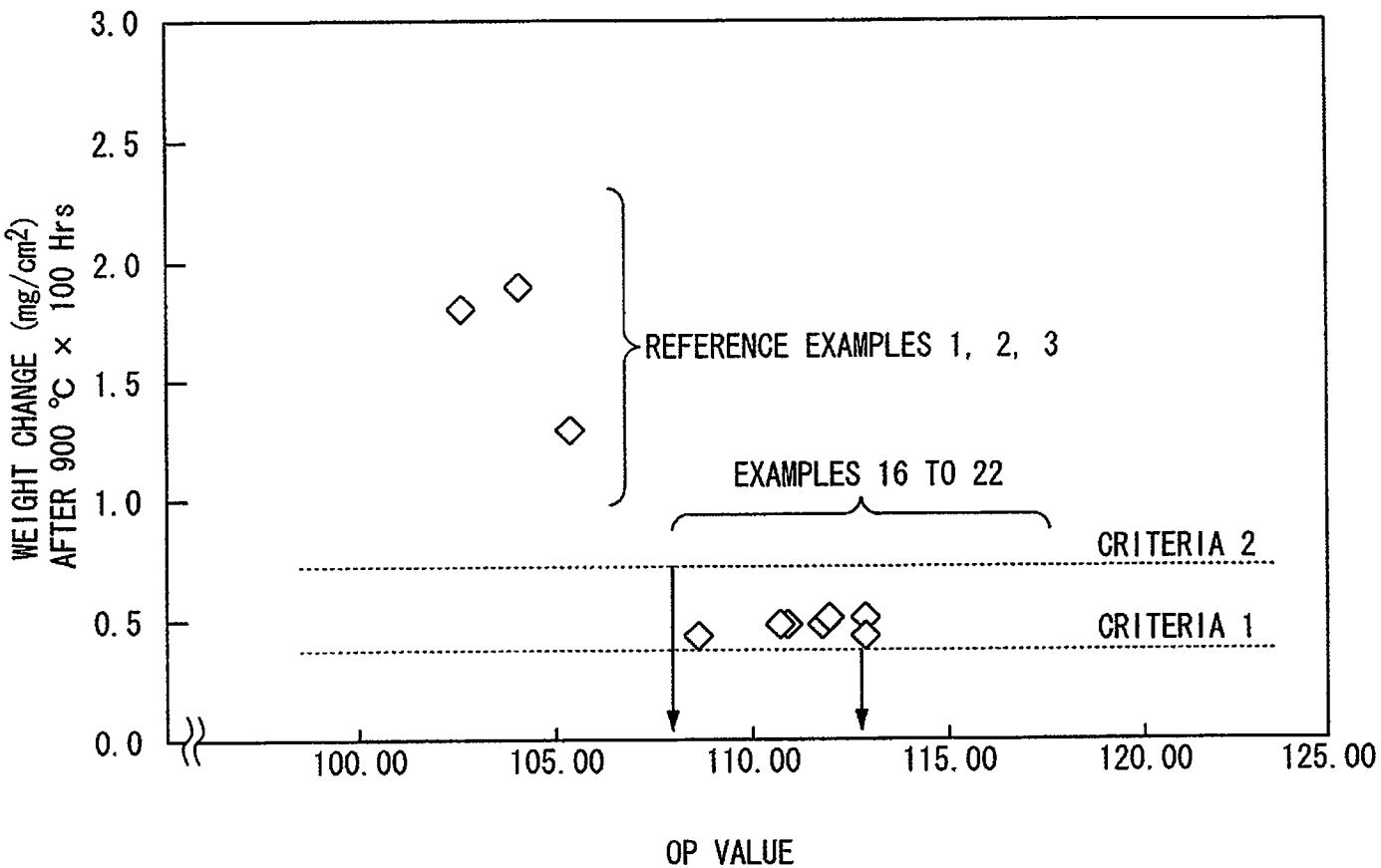
FIG. 10 is a diagram illustrating the relationship between an OP value and the measurement result of the weight change illustrated in FIG. 9.

FIG. 10 is a diagram illustrating the relationship between the OP value and the measurement result of the weight change illustrated in FIG. 9. Herein, a vertical axis represents the weight change (mg/cm$^2$) and a horizontal axis represents the OP value shown in Table 2. From FIG. 10, it is found that the examples 16 to 22 have almost the same result as in FIGS. 3, 4 and 7.

Industrial Applicability

According to a Ni-based single crystal superalloy of the invention, by setting the amounts of Al, Cr and Hf to their optimum ranges, oxidation resistance can be improved while creep strength is maintained.

The invention claimed is:

1. A Ni-based single crystal superalloy which has a composition including: 5.0 to 7.0 wt % of Al, 4.0 to 10.0 wt % of Ta, 1.1 to 4.5 wt % of Mo, 4.0 to 10.0 wt % of W, 3.1 to 8.0 wt % of Re, 0.0 to 2.0 wt % of Hf, 5.1 wt % to 8.5 wt % of Cr, 0.0 to 9.9 wt % of Co, 0.0 to 4.0 wt % of Nb, and 1.0 to 14.0 wt % of Ru in terms of weight ratio; and the remainder including Ni and incidental impurities, and wherein when a formula, that is, an oxidation parameter (OP)=5.5×[Cr (wt %)]+15.0×[Al (wt %)]+9.5×[Hf (wt %)] is set, the equation OP≥108 is satisfied, and wherein when a lattice constant of a matrix is denoted by al and a lattice constant of a precipitated phase is denoted by a2, the equation a2<0.999a1 is satisfied.

2. The Ni-based single crystal superalloy according to claim 1, wherein Hf is in the range of 0.0 to 0.5 wt %.

3. The Ni-based single crystal superalloy according to claim 1, wherein Hf is in the range of 0.0 to 0.5 wt %, Mo is in the range of 2.1 to 4.5 wt %, and Ta is in the range of 4.0 to 6.0 wt %.

4. The Ni-based single crystal superalloy according to claim 1, wherein when a formula, that is, an oxidation parameter (OP)=5.5×[Cr (wt %)]+15.0×[Al (wt %)]+9.5×[Hf(wt %)] is set, the equation OP≤113 is satisfied.

5. The Ni-based single crystal superalloy according to claim 1, further including 1.0 wt % or less of Ti in terms of weight ratio.

6. The Ni-based single crystal superalloy according to claim 1, wherein when a lattice constant of a matrix is denoted by al and a lattice constant of a precipitated phase is denoted by a2, the equation a2<0.9965a1 is satisfied.

7. The Ni-based single crystal superalloy according to claim 1, wherein when a formula, that is, P=−200[Cr (wt %)]+80[Mo (wt %)]−20[Mo (wt %)$^2$+200[W (wt %)]−14[W (wt %)]$^2$+30[Ta (wt %)]−1.5[Ta (wt %)]$^2$+2.5[Co (wt %)]+

$1200[Al\ (wt\ \%)]-100[Al\ (wt\ \%)]^2+100[Re\ (wt\ \%)]+1000[Hf\ (wt\ \%)]-2000[Hf\ (wt\ \%)]^2+700[Hf\ (wt\ \%)]^3$ is set, the equation $P<4500$ is satisfied.

8. A Ni-based single crystal superalloy which has a composition including: 5.0 to 6.5 wt % of Al, 4.0 to 6.5 wt % of Ta, 2.1 to 4.0 wt % of Mo, 4.0 to 6.0 wt % of W, 4.5 to 7.5 wt % of Re, 0.1 to 2.0 wt % of Hf, 5.1 wt % to 8.5 wt % of Cr, 4.5 to 9.5 wt % of Co, 0.0 to 1.5 wt % of Nb, and 1.5 to 6.5 wt % of Ru in terms of weight ratio; and the remainder including Ni and incidental impurities, and wherein when a formula, that is, an oxidation parameter $(OP)=5.5\times[Cr\ (wt\ \%)]+15.0\times[Al\ (wt\ \%)]+9.5\times[Hf\ (wt\ \%)]$ is set, the equation $OP\geq108$ is satisfied, and wherein when a lattice constant of a matrix is denoted by al and a lattice constant of a precipitated phase is denoted by a2, the equation $a2\leq0.999a1$ is satisfied.

9. The Ni-based single crystal superalloy according to claim 8, wherein Hf is in the range of 0.1 to 0.5 wt %.

10. A Ni-based single crystal superalloy which has a composition including: 5.5 to 5.9 wt % of Al, 4.7 to 5.6 wt % of Ta, 2.2 to 2.8 wt % of Mo, 4.4 to 5.6 wt % of W, 5.0 to 6.8 wt % of Re, 0.1 to 2.0 wt % of Hf, 5.1 wt % to 6.7 wt % of Cr, 5.3 to 9.0 wt % of Co, 0.0 to 1.0 wt % of Nb, and 2.3 to 5.9 wt % of Ru in terms of weight ratio; and the remainder including Ni and incidental impurities, and wherein when a formula, that is, an oxidation parameter $(OP)=5.5\times[Cr\ (wt\ \%)]+15.0\times[Al\ (wt\ \%)]+9.5\times[Hf\ (wt\ \%)]$ is set, the equation $OP\geq108$ is satisfied, and wherein when a lattice constant of a matrix is denoted by al and a lattice constant of a precipitated phase is denoted by a2, the equation $a2<0.999a1$ is satisfied.

11. The Ni-based single crystal superalloy according to claim 10, wherein Hf is in the range of 0.1 to 0.5 wt %.

* * * * *